US009660346B2

(12) United States Patent
Wu

(10) Patent No.: US 9,660,346 B2
(45) Date of Patent: May 23, 2017

(54) ANTENNA STRUCTURE

(71) Applicant: GETAC TECHNOLOGY CORPORATION, Hsinchu County (TW)

(72) Inventor: Jiun-Wei Wu, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 121 days.

(21) Appl. No.: 14/270,314

(22) Filed: May 5, 2014

(65) Prior Publication Data

US 2015/0318617 A1 Nov. 5, 2015

(51) Int. Cl.
*H01Q 9/04* (2006.01)

(52) U.S. Cl.
CPC ..... *H01Q 9/0421* (2013.01); *H01Q 9/0428* (2013.01)

(58) Field of Classification Search
CPC .. H01Q 9/0407; H01Q 9/0421; H01Q 9/0428; H01Q 9/30; H01Q 9/42; H01Q 21/24; H01Q 25/001; H01Q 1/22; H01Q 1/2258; H01Q 1/2266; H01Q 1/2283; H01Q 1/2291; H01Q 1/24; H01Q 1/241; H01Q 1/243; H01Q 9/045; H01Q 9/0492; H01Q 9/0478; H01Q 11/14; H01Q 5/364; H01Q 5/371
USPC ..... 343/702
See application file for complete search history.

(56) References Cited

U.S. PATENT DOCUMENTS 6,166,694 A * 12/2000 Ying ..... H01Q 1/243 343/700 MS
7,405,697 B2 * 7/2008 Ying ..... H01Q 1/243 343/700 MS
7,532,164 B1 * 5/2009 Phillips ..... H01Q 9/0428 343/700 MS
7,586,443 B2 * 9/2009 Takei ..... H01Q 1/243 343/700 MS
8,884,824 B2 * 11/2014 Andrenko ..... H01Q 1/243 343/700 MS
9,099,781 B2 * 8/2015 Jenwatanavet ..... H01Q 7/00

FOREIGN PATENT DOCUMENTS

WO WO 2012104433 A1 * 8/2012 ..... H01Q 1/2225

OTHER PUBLICATIONS

GPS Navstar, Global Positioning System Standard Positiong Service Signal Specification, Jun. 2, 1995, GPS Navstar, 2nd Ed, p. 6.*

* cited by examiner

*Primary Examiner* — Tho G Phan
*Assistant Examiner* — Patrick Holecek

(57) ABSTRACT

An antenna structure and an electronic device are provided. The antenna structure includes a connecting part, a grounding part, a first extending part and a second extending part. An angle is larger than zero between a first vector from the connecting point to the first open terminal and a second vector from the connecting point to the second open terminal. Also, a difference between the path length of a first path length and the path length of a second path length would be a quarter of the wave length of the radio frequency signal or a positive integer times thereof, so that the antenna is capable of receiving the radio frequency signal with circular polarizing.

15 Claims, 2 Drawing Sheets

ANTENNA STRUCTURE

BACKGROUND OF THE INVENTION

Field of the Invention

The present invention relates to electronic devices, and more particularly, to an antenna structure and an electronic device comprising the antenna structure.

Description of the Prior Art

In general, radio frequency signals operate by linear polarization or circular polarization; hence, radio frequency signals undergo polarization in a way conducive to their application. For instance, all the electromagnetic waves of the positioning signals defined pursuant to the regulations of global positioning systems (GPS) usually operate by circular polarization. To receive the positioning signals operating by circular polarization, the signal receiving end is equipped with an antenna operating by circular polarization, such as a patch antenna or a ceramic antenna, so as to receive and send the positioning signals efficiently. Both the two aforesaid antennas are close to perfect circular polarization but have narrow inherent bandwidth and narrow circular polarization bandwidth. The two aforesaid antennas will still meet bandwidth requirements, if the received positioning signals are merely applied to the aforesaid GPS. However, if the received positioning signals are applied to both the aforesaid GPS and global navigation satellite systems (GNSS), the bandwidth provided by the two aforesaid antennas will be inadequate.

Moreover, ceramic antennas are made of ceramic materials of high rigidity, whereas the bandwidth of patch antennas is narrow, and in consequence antenna designers find it difficult to fine-tune the receiving and sending frequencies. Both patch antennas and ceramic antennas take up much area when mounted in place. Furthermore, although conventional PIFA has wide signal receiving and sending bandwidth, it involves linear polarization of electromagnetic waves rather than circular polarization of electromagnetic waves. Hence, the prior art is not only confronted with the trend toward downsized electronic devices, but is also required to mount a circularly polarized and compact antenna on ever-diminishing electronic devices.

SUMMARY OF THE INVENTION

The present invention provides an antenna structure and an electronic device characterized in that a circularly polarized planar inverted F antenna (PIFA) receives and sends a circularly polarized radio frequency signal.

The present invention provides an antenna structure adapted to receive and send a radio frequency signal. The antenna structure comprises a connecting portion, a grounding portion, a first extending portion, and a second extending portion. The connecting portion has a feeding point and connecting point. The grounding portion is connected to connecting point and has a grounding point. The first extending portion is connected to connecting point and has a first open terminal. The second extending portion is connected to connecting point and has a second open terminal. A first vector goes from the connecting point to the first open terminal. A second vector goes from the connecting point to the second open terminal. An included angle larger than zero is formed between the first vector and the second vector. The difference between the length of a first path defined between the feeding point and the first open terminal and the length of a second path defined between the feeding point and the second open terminal equals one-fourth or a positive integer multiple of the wavelength of the radio frequency signal, so as for the antenna structure to receive and send a circularly polarized radio frequency signal.

An electronic device comprises an antenna structure and a signal processing unit. The signal processing unit is connected to the antenna structure. The antenna structure receives and sends a radio frequency signal. The antenna structure comprises a connecting portion, a grounding portion, a first extending portion, and a second extending portion. The connecting portion has a feeding point and connecting point. The grounding portion is connected to connecting point and has a grounding point. The first extending portion is connected to connecting point and has a first open terminal. The second extending portion is connected to connecting point and has a second open terminal. A first vector goes from the connecting point to the first open terminal. A second vector goes from the connecting point to the second open terminal. An included angle larger than zero is formed between the first vector and the second vector. The difference between the length of a first path defined between the feeding point and the first open terminal and the length of a second path defined between the feeding point and the second open terminal equals one-fourth or a positive integer multiple of the wavelength of the radio frequency signal, so as for the antenna structure to receive and send a circularly polarized radio frequency signal.

Accordingly, the present invention provides an antenna structure and an electronic device with the antenna structure, characterized in that a phase difference between two electric currents which follow two electric current paths of different length renders it practicable for the antenna structure to receive and send a circularly polarized radio frequency signal.

BRIEF DESCRIPTION OF THE DRAWINGS

To enable persons skilled in the art to fully understand the features and advantages of the present invention, the present invention is hereunder illustrated with embodiments in conjunction with the accompanying drawings, in which.

DETAILED DESCRIPTION OF THE EMBODIMENTS

Figure 1:
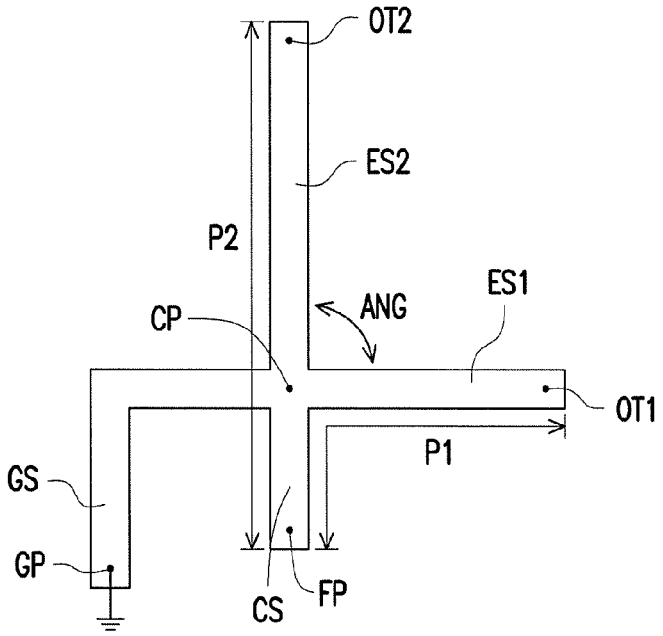
FIG. 1 is a structural schematic view of an antenna structure according to an embodiment of the present invention.

Referring to FIG. 1, there is shown a structural schematic view of an antenna structure according to an embodiment of the present invention. Referring to FIG. 1, the antenna structure is disposed in an electronic device and adapted to receive and send a radio frequency signal. The antenna structure 10 comprises a connecting portion CS, a grounding portion GS, an extending portion ES1, and an extending portion ES2.

The connecting portion CS has a feeding point FP and a connecting point CP. The grounding portion GS is connected to the connecting point CP and has a grounding point GP, wherein the grounding point GP is coupled to the system ground plane. The extending portion ES1 is connected to the connecting point CP and has an open terminal OT1. The extending portion ES2 is connected to the connecting point CP and has an open terminal OT2. A first vector goes from the connecting point CP to the open terminal OT1. A second vector goes from the connecting point CP to the open terminal OT2. An included angle ANG larger than zero is formed between the first vector and the second vector. In this embodiment, the included angle ANG is 90° substantially. However, in practice, the magnitude of the included angle ANG is subject to change according to practical antenna design regulations.

In general, although the conventional PIFA has a wide signal receiving and sending bandwidth, it involves linear polarization of electromagnetic waves rather than circular polarization of electromagnetic waves. In the situation where two electric current paths are simply provided in the PIFA, electromagnetic waves generated from the electric currents are polarized in a specific direction, resulting in linear polarization or substantially elliptic polarization instead of circular polarization. To overcome the aforesaid drawback, the present invention is advantageously characterized in that circular polarization of a radio frequency signal is achieved because of a phase difference of 90° between two electric currents which follow two electric current paths (i.e., paths P1, P2) provided in the antenna structure 10, respectively.

Referring to FIG. 1, in this embodiment of the antenna structure 10, the difference between the length of path P1 defined between the feeding point FP and the open terminal OT1 and the length of path P2 defined between the feeding point FP and the open terminal OT2 equals one-fourth or a positive integer multiple of the wavelength of the radio frequency signal, so as for the antenna structure 10 to receive and send a circularly polarized radio frequency signal. In short, the difference in length between paths P1, P2 brings about a phase difference of 90° between the two paths P1, P2 while the antenna structure 10 is receiving and sending signals, such that antenna structure 10 can receive and send the circularly polarized radio frequency signal.

It is practicable to determine whether the circular polarization of the antenna structure 10 is left-hand circular polarization (LHCP) or right-hand circular polarization (RHCP) by determining which of the paths P1, P2 is longer. In this embodiment, path P2 is longer than path P1, when the antenna structure 10 is receiving and sending signals, the phase angle of the electric current carried by path P1 relative to the electromagnetic waves (or signals) emitted lags the phase angle of the electric current carried by path P2 relative to the electromagnetic waves (or signals) emitted by 90°, thereby resulting in right-hand circular polarization (RHCP). All the information exchange processes which take place in the existing GPS involve right-hand circular polarization of radio frequency signals, and thus the antenna structure 10 shown in FIG. 1 is adapted to receive and send the positioning signals of the GPS.

By contrast, in another embodiment of the present invention, path P1 is longer than path P2, and thus the antenna structure 10 is characterized by left-hand circular polarization. Antenna designers determine whether path P1 is longer than path P2 as needed.

In yet another embodiment of the present invention, for a configurative purpose, the antenna structure 10 is characterized in that one of the extending portions ES1, ES2 has one or more bends to thereby reduce the overall area taken up by the antenna structure 10 or achieve a phase difference of 90° between the two paths.

Figure 2:
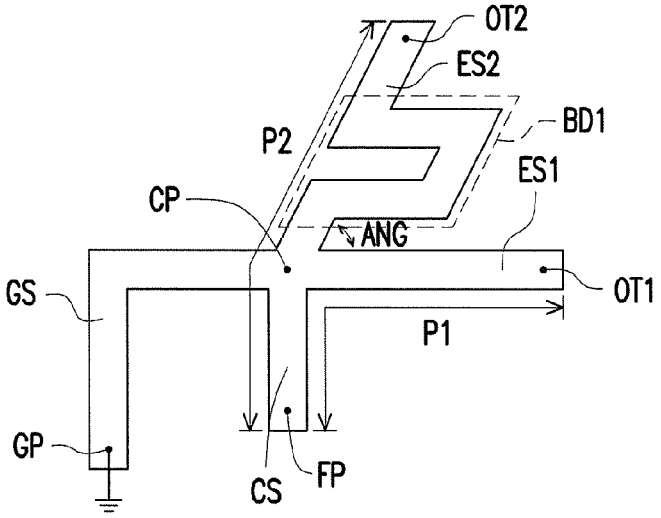
FIG. 2 is a structural schematic view of the antenna structure according to an embodiment of the present invention.

Referring to FIG. 2, there is shown a structural schematic view of the antenna structure according to an embodiment of the present invention. Constituent elements of the antenna structure 10 illustrated with FIG. 2 are identical to constituent elements of the antenna structure 10 illustrated with FIG. 1 and thus are not described herein for the sake of brevity. The embodiment illustrated with FIG. 2 is different from the embodiment illustrated with FIG. 1 in that, regarding the antenna structure 10 shown in FIG. 2, the extending portion ES2 comprises a bent portion BD1. In this embodiment, like the embodiment illustrated with FIG. 1, the difference in length between path P2 and path P1 still equals one-fourth or a positive integer multiple of the wavelength of the radio frequency signal. The bent path P2 lags path P1 by a phase difference of 90° by means of the design of the bent BD1.

In this embodiment, although the bent portion BD1 manifests a bend only, it is also practicable for the bent portion BD1 to have multiple bends. The multiple bends can be effectuated, provided that the requirement "path P2 lags or precedes path P1 by a phase difference of 90°" is met. Alternatively, circular polarization can be effectuated, provided that the requirement "the difference in length between path P2 and path P1 equals one-fourth or a positive integer multiple of the wavelength of the radio frequency signal" is met. Basically, the two aforesaid requirements refer to the same phenomenon. Specifically speaking, persons skilled in the art understand that, in a graph of the function of a sinusoidal wave against phase angle, lagging or preceding by a phase difference of 90° is a paraphrase of lagging or preceding by one-fourth or a positive integer multiple of the wavelength of the sinusoidal wave.

Figure 3:
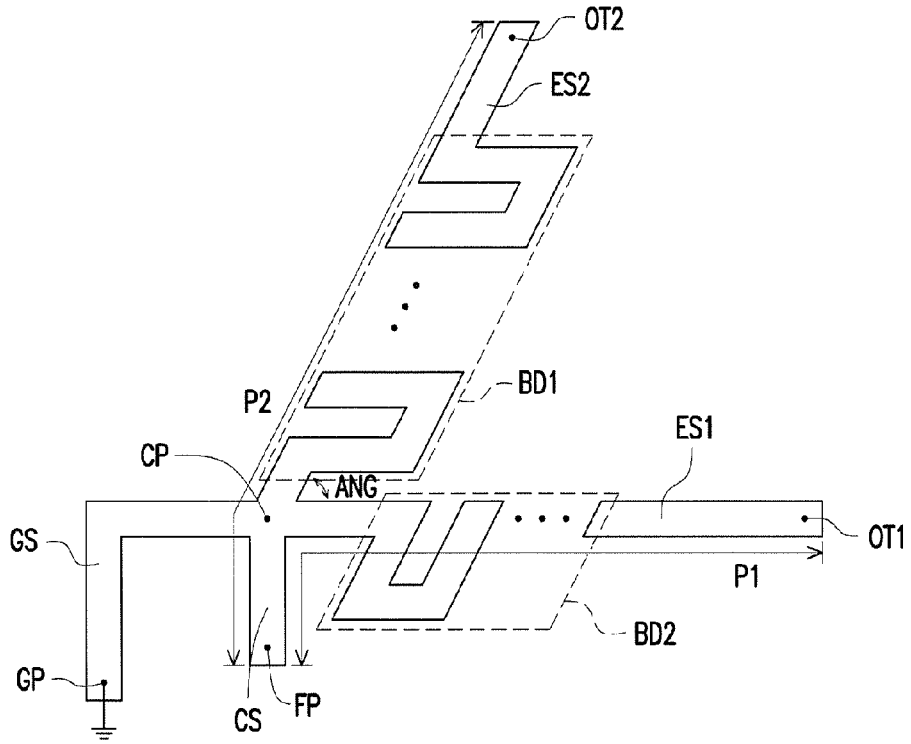
FIG. 3 is a structural schematic view of the antenna structure according to an embodiment of the present invention.

Referring to FIG. 3, there is shown a structural schematic view of the antenna structure according to an embodiment of the present invention. Constituent elements of the antenna structure 10 shown in FIG. 3 are identical to constituent elements of the antenna structure 10 shown in FIGS. 1, 2 and thus are not described herein for the sake of brevity. The embodiment illustrated with FIG. 3 is different from the embodiment illustrated with FIG. 2 in that, the extending portion ES2 of the antenna structure 10 shown in FIG. 2 comprises the bent portion BD1, whereas the extending portion ES1 also comprises a bent portion BD2. Furthermore, each of the bent portions BD1, BD2 of the extending portion ES2 of the antenna structure 10 has multiple bends. Likewise, the antenna structure 10 shown in FIG. 3 also meets the requirement "the difference in length between path P2 and path P1 still equals one-fourth or a positive integer multiple of the wavelength of the radio frequency signal." Alternatively, the antenna structure 10 shown in FIG. 3 also meets the requirement "path P2 lags or precedes path P1 by a phase difference of 90°."

In practice, the extending portions ES1, ES2 are of equal or different length as needed (i.e., the length of the first vector and the second vector). In short, in the situation where the extending portions ES1, ES2 are of equal length (i.e., the first vector and the second vector are of equal length), the longer path (i.e., path P2 in this embodiment) can have multiple bends, provided that the aforesaid requirement "path P2 lags path P1 by a phase difference of 90°" is met. Furthermore, when the aforesaid design is applied to a PIFA, an additional advantage is attained, that is, reducing the required area taken up by the antenna structure 10. For instance, the length of path P1 equals a half of the wavelength of the radio frequency signal and the length of the extending portion ES1 equals one-fourth of the wavelength of the radio frequency signal, whereas the length of path P2 equals three-fourths of the wavelength of the radio frequency signal and the length of the extending portion ES2 equals one-fourth of the wavelength of the radio frequency signal. Hence, if the length of the extending portions ES1, ES2 equals one-fourth of the wavelength of the radio frequency signal and the difference in length between paths P1, P2 equals one-fourth of the wavelength of the radio frequency signal, circularly polarized radiation will be effectuated. The aforesaid embodiments are illustrative rather than restrictive of the present invention.

Figure 4:
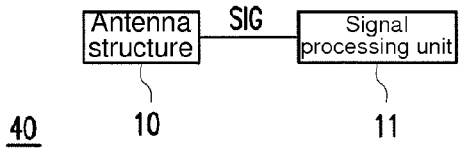
FIG. 4 is a functional block diagram of an electronic device according to an embodiment of the present invention.

The present invention further provides an electronic device. Referring to FIG. 4, there is shown a functional block diagram of an electronic device according to an embodiment of the present invention. Referring to FIG. 4, the electronic device 40 comprises the antenna structure 10 and a signal processing unit 11. The signal processing unit 11 is connected to the antenna structure 10. The antenna structure 10 receives and sends a radio frequency signal SIG. The antenna structure 10 comprises a connecting portion, a grounding portion, a first extending portion, and a second extending portion. The connecting portion has a feeding point and a connecting point. The grounding portion is connected to the connecting point and has a grounding point, wherein the grounding point is connected to the system ground plane of the electronic device. The first extending portion is connected to the connecting point and has a first open terminal. The second extending portion is connected to the connecting point and has a second open terminal. A first vector goes from the connecting point to the first open terminal. A second vector goes from the connecting point to the second open terminal. An included angle larger than zero is formed between the first vector and the second vector. The difference between the length of a first path defined between the feeding point and the first open terminal and the length of a second path defined between the feeding point and the second open terminal equals one-fourth or a positive integer multiple of the wavelength of the radio frequency signal SIG, so as for the antenna structure 10 to receive and send the circularly polarized radio frequency signal SIG. The details of the implementation of the antenna structure 10 are illustrated with the embodiments depicted by FIGS. 1-3 and thus are not described herein for the sake of brevity. For example, in the embodiment of the antenna structure 10 illustrated with FIG. 1, the path P1 is shorter than path P2 and the difference in length therebetween equals one-fourth or a positive integer multiple of the wavelength of the radio frequency signal SIG, so as for the antenna structure 10 to receive and send a right-hand circularly polarized radio frequency signal SIG; hence, the electronic device 40 uses the antenna structure 10 to receive and send the positioning signals of the GPS. Similarly, if path P1 is longer than path P2 and the difference in length therebetween equals one-fourth or a positive integer multiple of the wavelength of the radio frequency signal SIG, so as for the antenna structure 10 to receive and send a left-hand circularly polarized radio frequency signal SIG.

In conclusion, the present invention provides an antenna structure and an electronic device with the antenna structure, characterized in that: the structure of a conventional PIFA is modified in a manner to cause the difference in length between paths (i.e., paths P1, P2) of two electric currents to equal one-fourth or a positive integer multiple of the wavelength of a radio frequency signal, such that one said electric current lags or precedes the other said electric current by a phase difference of 90°, thereby effectuating circularly polarized radiation. The antenna structure of the present invention is effective in increasing circular polarization bandwidth. Unlike ceramic antennas and patch antennas, the antenna structure of the present invention not only takes up a relatively small area when mounted in place but is also easy to fine-tune its operating frequency, and thus is not subject to material (such as ceramic material) requirements or the other mounting requirements.

Although the present invention is disclosed above by embodiments, the embodiments are not restrictive of the present invention. Hence, persons skilled in the art can make slight changes and modifications to the aforesaid embodiments without departing from the spirit and scope of the present invention. Accordingly, the legal protection for the present invention should be defined by the appended claims.

What is claimed is:

1. An antenna structure for receiving and sending a radio frequency signal, comprising:

a connecting portion having a feeding point and a connecting point at opposite ends thereof;

a grounding portion extending from the connecting point and having a grounding point at an end opposite to the connecting point;

a first extending portion extending continuously from the connecting point to a first open terminal at an end opposite to the connecting point; and a second extending portion extending continuously from the connecting point to a second open terminal at an end opposite to the connecting point;

wherein a first vector goes from the connecting point to the first open terminal, and a second vector goes from the connecting point to the second open terminal, such that an included angle larger than zero is formed between the first vector and the second vector;

wherein a difference between a length of a first path defined between the feeding point and the first open terminal of the first extending portion and a length of a second path defined between the feeding point and the second open terminal of the second extending portion equals one-fourth or a positive integer multiple of a wavelength of the radio frequency signal such that electric currents respectively following the first and second paths have a phase difference of 90°, so as for the antenna structure to receive and send a circularly polarized radio frequency signal; and wherein the connecting portion, the grounding portion, the first extending portion, and the second extending portion are joined at the connecting point and extend in four different directions therefrom.

2. The antenna structure as claimed in claim 1, wherein at least one of the first extending portion and the second extending portion has at least one back and forth bend, such that a difference between a length of the first path and a length of the second path equals one-fourth of a wavelength of the radio frequency signal.

3. The antenna structure as claimed in claim 1, wherein the first path is shorter than the second path and a difference in length therebetween equals one-fourth or a positive integer multiple of a wavelength of the radio frequency signal, so as for the antenna structure to receive and send a right-hand circularly polarized radio frequency signal.

4. The antenna structure as claimed in claim 1, wherein the first path is longer than the second path and a difference in length therebetween equals one-fourth or a positive integer multiple of a wavelength of the radio frequency signal, so as for the antenna structure to receive and send a left-hand circularly polarized radio frequency signal.

5. The antenna structure as claimed in claim 1, wherein at least one of the first extending portion and the second extending portion has a plurality of back and forth bends, such that a difference between a length of the first path and a length of the second path equals one-fourth of a wavelength of the radio frequency signal.

6. The antenna structure as claimed in claim 5, wherein a length of first vector is equal to a length of the second vector.

7. An electronic device, comprising:

an antenna structure; and a signal processing unit connected to the antenna structure, the antenna structure receiving and sending a radio frequency signal, wherein the antenna structure comprises:

a connecting portion having a feeding point and a connecting point at opposite ends thereof;

a grounding portion extending from the connecting point and having a grounding point at an end opposite to the connecting point;

a first extending portion extending continuously from the connecting point to a first open terminal at an end opposite to the connecting point; and a second extending portion extending continuously from the connecting point to a second open terminal at an end opposite to the connecting point;

wherein a first vector goes from the connecting point to the first open terminal, and a second vector goes from the connecting point to the second open terminal, such that an included angle larger than zero is formed between the first vector and the second vector;

wherein a difference between a length of a first path defined between the feeding point and the first open terminal of the first extending portion and a length of a second path defined between the feeding point and the second open terminal of the second extending portion equals one-fourth or a positive integer multiple of a wavelength of the radio frequency signal such that electric currents respectively following the first and second paths have a phase difference of 90°, so as for the antenna structure to receive and send a circularly polarized radio frequency signal; and wherein the connecting portion, the grounding portion, the first extending portion, and the second extending portion are joined at the connecting point and extend in four different directions therefrom.

8. The electronic device as claimed in claim 7, wherein at least one of the first extending portion and the second extending portion has at least one back and forth bend, such that a difference between a length of the first path and a length of the second path equals one-fourth of a wavelength of the radio frequency signal.

9. The electronic device as claimed in claim 7, wherein the first path is shorter than the second path and a difference in length therebetween equals one-fourth or a positive integer multiple of a wavelength of the radio frequency signal, so as for the antenna structure to receive and send a right-hand circularly polarized radio frequency signal.

10. The electronic device as claimed in claim 7, wherein the first path is longer than the second path and a difference in length therebetween equals one-fourth or a positive integer multiple of a wavelength of the radio frequency signal, so as for the antenna structure to receive and send a left-hand circularly polarized radio frequency signal.

11. The electronic device as claimed in claim 7, wherein at least one of the first extending portion and the second extending portion has a plurality of back and forth bends, such that a difference between a length of the first path and a length of the second path equals one-fourth of a wavelength of the radio frequency signal.

12. The electronic device as claimed in claim 11, wherein a length of first vector is equal to a length of the second vector.

13. An antenna structure for receiving and sending a radio frequency signal, comprising:

a connecting portion having a feeding point and a connecting point at opposite ends thereof;

a grounding portion extending from the connecting point and having a grounding point at an end opposite to the connecting point;

a first extending portion extending continuously from the connecting point to a first open terminal at an end opposite to the connecting point; and a second extending portion extending continuously from the connecting point to a second open terminal at an end opposite to the connecting point, wherein a first vector goes from the connecting point to the first open terminal, and a second vector goes from the connecting point to the second open terminal, such that a substantially right angle is formed between the first vector and the second vector;

wherein a length of the first extending portion is different from a length of the second extending portion by one-fourth or a positive integer multiple of a wavelength of the radio frequency signal, such that the antenna structure receives and sends a circularly polarized radio frequency signal; and wherein the connecting portion, the grounding portion, the first extending portion, and the second extending portion are joined at the connecting point and extend in four different directions therefrom.

14. The antenna structure as claimed in claim 13, wherein at least one of the first extending portion and the second extending portion has a plurality of back and forth bends such that electric currents respectively following the first and second paths have a phase difference of 90°.

15. The antenna structure as claimed in claim 14, wherein a length of first vector is equal to a length of the second vector.

* * * * *